US005083326A

United States Patent [19]

Casebier, III

[11] Patent Number: 5,083,326

[45] Date of Patent: Jan. 28, 1992

[54] APPARATUS FOR PROTECTING AGAINST EXPANSION OF FREEZING WATER

[76] Inventor: Charles E. Casebier, III, 1601 Westridge Ct., Hurst, Tex. 76054

[21] Appl. No.: 353,593

[22] Filed: May 18, 1989

[51] Int. Cl.[5] ..... E04H 3/19

[52] U.S. Cl. ..... 4/504; 4/496; 441/136

[58] Field of Search ..... 4/496, 497, 504; 114/230, 343, 354; 441/136; 405/21, 23, 26, 28, 61, 66; 224/901

[56] References Cited

U.S. PATENT DOCUMENTS

| | | | |
|---|---|---|---|
| 917,690 | 4/1909 | Weese | 227/124 |
| 3,050,750 | 8/1962 | Harrison | 441/136 |
| 3,072,922 | 1/1963 | Pyke | 4/504 |
| 3,802,007 | 4/1974 | Dolan, Jr. | 441/136 |
| 3,923,411 | 12/1975 | Berghman | 404/64 |
| 3,971,075 | 7/1976 | Heinbaugh et al. | 52/169.7 |
| 4,285,082 | 8/1981 | Cox | 224/901 |
| 4,290,249 | 9/1981 | Mass | 52/396 |
| 4,362,427 | 12/1982 | Mass et al. | 404/64 |

FOREIGN PATENT DOCUMENTS

| | | | |
|---|---|---|---|
| 0838073 | 6/1981 | U.S.S.R. | 4/497 |

*Primary Examiner*—Henry J. Recla
*Assistant Examiner*—Glenn T. Barrett
*Attorney, Agent, or Firm*—H. Dennis Kelly

[57] ABSTRACT

Disclosed is an apparatus for protecting a swimming pool against damage due to forces created as water in the pool freezes and expands. The apparatus includes a hull that floats on the surface of the water and compresses as the water freezes and expands. A pair of straps attach the hull to a pair of bean bags to keep the float in a selected position near the side of the pool. The hull has a pair of side members and a pair of end members, forming a watertight hull. The side members are connected together along a common edge to form a V-shaped cross section. A plurality of weights are located in a semicircular slot along the common edge to keep the common edge downward in the water.

8 Claims, 2 Drawing Sheets

APPARATUS FOR PROTECTING AGAINST EXPANSION OF FREEZING WATER

BACKGROUND OF THE INVENTION

1. Field of the Invention

This invention relates in general to devices for protecting against forces resulting from the expansion of freezing water. In particular, the invention relates to devices to be placed in a swimming pool to keep the pool liner from cracking as water in the pool freezes and expands.

2. Description of the Prior Art

During periods of freezing temperatures precautions must be taken to avoid damage due to the expansion of freezing water. Boats, piers, and swimming pools can be damaged as water freezes and expands. Many swimming pool owners simply drain their pools for the winter. However, for various reasons draining the pool may not be practical or desired.

If the pool is not drained, other measures must be taken to keep expanding ice from cracking the concrete or plastic lining of the pool. One possibility is the placing of a wooden log in the water to absorb the forces of the expanding ice. However, a wooden log may contain undesirable substances, and these substances may leach out of the log into the water. Also, the log may float out into the middle of the pool, where it is difficult to retrieve.

It is therefore desirable to provide an apparatus for absorbing the forces created as freezing water expands, without harming the quality of the water. Also, it is desirable to anchor the apparatus in a selected location near the side of the pool, rather than to allow the apparatus to float aimlessly around the pool.

SUMMARY OF THE INVENTION

The apparatus of the invention includes a float for absorbing the forces of the freezing water as it expands. A strap is attached between a weighted bag and a hook and fiber connector on the float. The weighted bag and the strap secures the float to a selected position near the side of the pool.

The float has two side members connected together along a common edge to form a V-shaped cross section. An end member is connected to each end of the side members to form a watertight hull. Several weights are secured within a semicircular slot along the common edge of the side members to keep the common edge of the side members downward in the water.

DESCRIPTION OF THE PREFERRED EMBODIMENT

Figure 1:
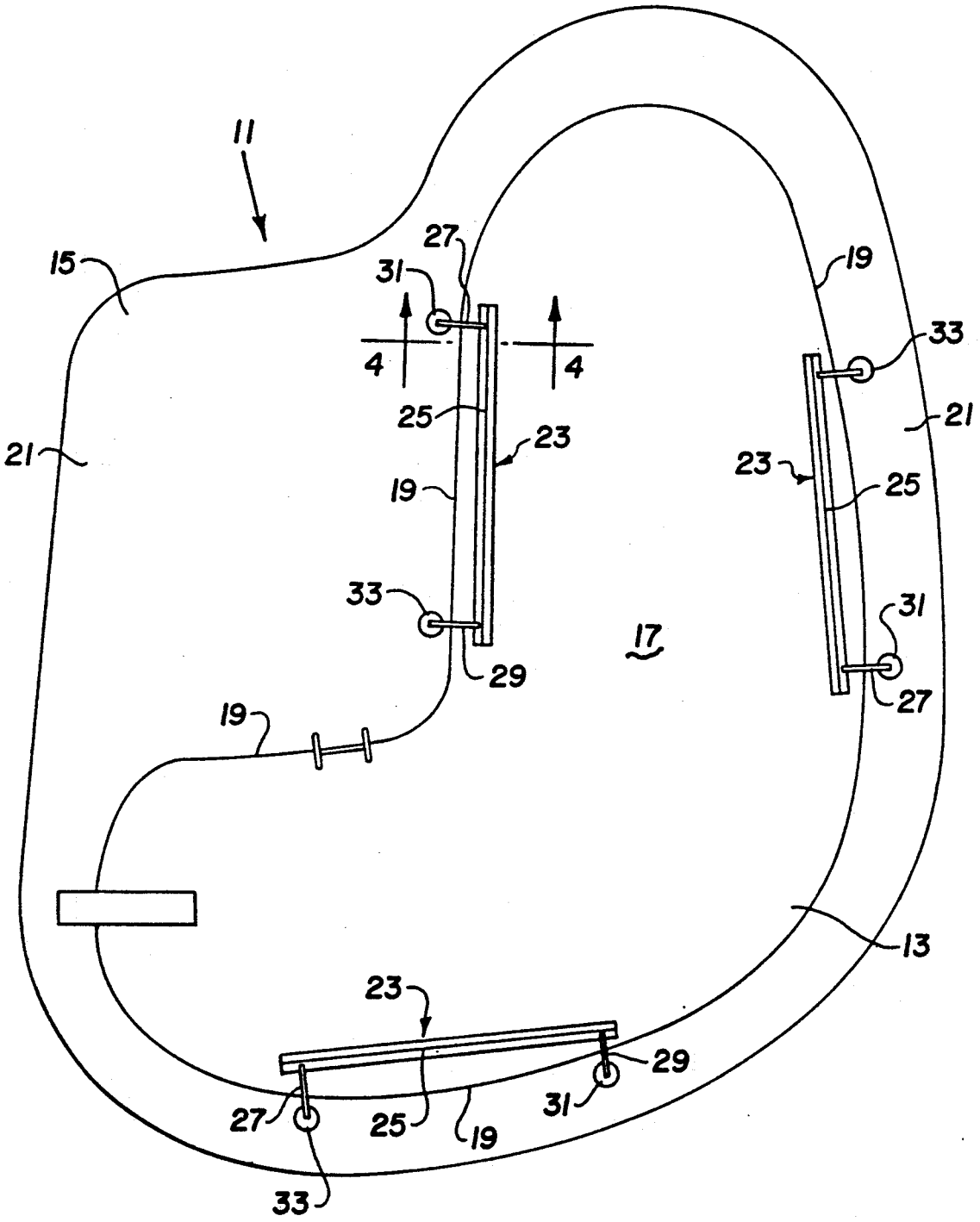
FIG. 1 is a top view of a typical swimming pool in which three apparatus of the invention have been installed.

FIG. 1 illustrates a typical swimming pool 11, in which water 13 is contained in a concrete or plastic liner 15. The liner 15 has a bottom 17, a plurality of sides 19, and a top 21. During freezing temperatures, the surface of the water 13 in the pool 11 may freeze and expand. As the ice expands, it exerts a force against the sides 19 of the pool 11. If the forces are excessive, the liner 15 may crack.

In order to relieve the forces against the liner 15, several apparatus 23 incorporating the invention are placed within the pool 11, as shown in FIG. 1. Each apparatus 23 includes a watertight hull 25 that floats on the surface of the water 13. As the water 13 freezes and expands, the hull 25 compresses and relieves the forces on the pool liner 15.

A pair of straps 27 and 29 are attached to the float 25. The other end of each strap 27 and 29 is attached to a weighted bag, such as a bean bag 31 and 33. The bean bags 31 and 33 are placed on the top 21 of the pool liner 15, near a side 19. The straps 27 and 29 and the bean bags 31 and 33 secure the hull 25 in a selected position near the side 19 of the pool 11.

Figure 2:
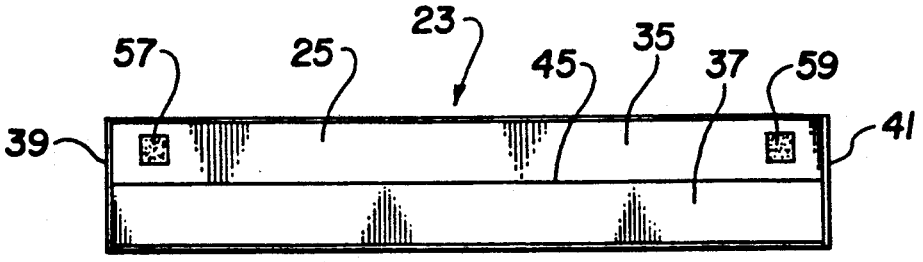
FIG. 2 is a top view of the apparatus of the invention.
Figure 3:
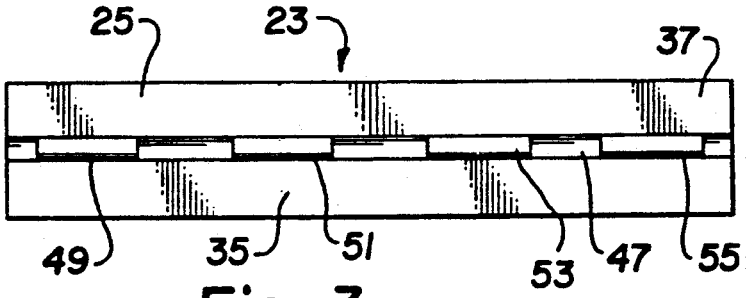
FIG. 3 is a bottom view of the apparatus of the invention.
Figure 4:
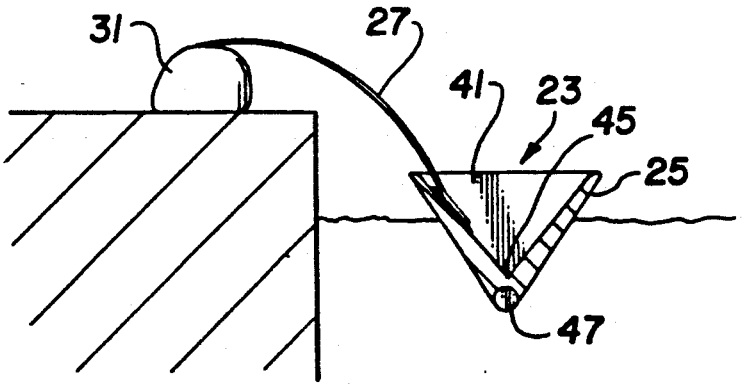
FIG. 4 is a sectional view of the apparatus of the invention, as seen along lines IV—IV in FIG. 2.

FIGS. 2–4 illustrate the apparatus 23 of the invention in greater detail. Each hull 25 has a pair of side members 35 and 37 and a pair of end members 39 and 41, connected together to form the watertight hull 25. The side members 35 and 37 and the end members 39 and 41 are made of a light weight material, such as plastic. The side members 35 and 37 are connected together along a common edge 45 to form a V-shaped cross section, as shown in FIG. 4.

A semicircular slot 47 runs along the length of the common edge 45 between the side members 35 and 37. Four metal weights 49, 51, 53, and 55 are secured within the slot 47. The weights 49, 51, 53, and 55 keep the common edge 45 of the side members 35 and 37 downward in the water 13. Keeping the common edge 45 downwards helps to keep water 13 out of the hull 25.

The straps 27 and 29 are connected to one of the side members 35 by means of connectors 57 and 59. Preferred connectors are hook and fiber connectors, such as the connectors sold under the trademark Velcro.

When there is a danger of freezing, the straps 27 and 29 are attached to the hull 25, and the hull 25 is placed in the water 13 near a side 19 of the pool 11. The two bean bags 31 and 33, attached to the straps 27 and 29, are placed on top 21 of the pool 11 near the selected side 19. The bean bags 31 and 33 and the straps 27 and 29 hold the hull 25 in the selected position near the side 19 of the pool 11. If the water 13 in the pool 11 freezes and expands, the two side members 35 and 37 of the hull 25 will compress toward one another and relieve the force of the ice 13 on the pool liner 15.

The apparatus 23 of the invention has several advantages over the prior art. The hull 25 compresses and relieves the forces on the pool liner 15 to prevent cracking. The apparatus 23 is easy to install and to retrieve, because the bean bags 31 and 33 keep the float 25 close to the selected side 19 of the pool 11. Also, the materials with which the apparatus 23 is constructed do not leach out into the water 13 in the pool 11.

The apparatus 23 of the invention can also be used to protect boats, piers, and other structures located in water. Another possible use is to place the apparatus 23 in other containers, such as water storage tanks.

The invention has been shown in only one of its embodiments. It should be apparent to those skilled in the art that the invention is not so limited, but is susceptible to various changes and modifications without departing from the spirit of the invention.

I claim:

1. An apparatus for protecting a swimming pool having sides against damage due to water expansion as water in the pool freezes, comprising:

a pair of rectangular side members, connected together along a common edge to form a V-shaped cross section, wherein the side members compress toward one another as the water freezes and expands;

a pair of end members, each end member being attached to one end of the side members to form a watertight hull; and a weight located within a semi-circular slot along the common edge of the side members for keeping the common edge of the side members downward in the water.

2. An apparatus as recited in claim 1, further comprising:

a strap attached to one of the side members; and a weighted bag attached to the strap for securing the strap to a selected position on one side of the pool.

3. An apparatus as defined in claim 2, wherein the weighted bag is a bean bag.

4. An apparatus as defined in claim 2, wherein the strap is attached to the side member by means of a hook and a fiber connector.

5. An apparatus for absorbing forces due to water expansion as water in a container freezes, comprising:

a pair of side members connected together along a common edge to form a V-shaped cross section;

a pair of end members, each end member being connected to one end of the side members to form a hull;

a weight attached within a semi-circular slot along the common edge of the side members to keep the common edge of the side members downward in the water;

a strap attached to the hull; and a weighted bag located on one side of the container and attached to the strap for securing the strap to a selected position relative to the sides of the container.

6. An apparatus as defined in claim 5, wherein the weighted bag is a bean bag.

7. An apparatus as defined in claim 5, wherein the strap is attached to the hull by means of a hook and fiber connector.

8. An apparatus for absorbing forces due to water expansion as water freezes, comprising:

a pair of rectangular side members, connected together along a common edge to form a V-shaped cross section, wherein the side members compress toward one another as the water freezes and expands;

a pair of end members, each end member being attached to one end of the side members to form a watertight hull; and a weight located within a semi-circular slot along the common edge of the side members for keeping the common edge of the side members downward in the water.

* * * * *